United States Patent [19]

McKinney et al.

[11] 4,415,378

[45] Nov. 15, 1983

[54] CASE HARDENING METHOD FOR STEEL PARTS

[75] Inventors: Joe R. McKinney; Roy G. Swagger, both of Douglasville, Pa.

[73] Assignee: Dana Corporation, Toledo, Ohio

[21] Appl. No.: 370,719

[22] Filed: Apr. 22, 1982

[51] Int. Cl.[3] ..... C21A 1/00

[52] U.S. Cl. ..... 148/12.1; 148/16.5

[58] Field of Search ..... 148/12.1, 16.5

[56] References Cited

U.S. PATENT DOCUMENTS

| | | | |
|---|---|---|---|
| 1,152,157 | 8/1915 | Farmer | 148/12.1 |
| 2,365,956 | 12/1944 | Hodge | 148/12 |
| 3,513,038 | 5/1970 | Weil | 148/19 |
| 3,661,656 | 5/1972 | Jarleborg | 148/12.1 |
| 4,131,491 | 12/1978 | Joseph | 148/12.1 |
| 4,350,538 | 9/1982 | Imai et al. | 148/12.1 |

OTHER PUBLICATIONS

Metals Handbook, vol. 2, 8th Ed., Heat Treating, Cleaning and Finishing, 1964, pp. 398–405.

*Primary Examiner*—Veronica O'Keefe

*Attorney, Agent, or Firm*—Frank B. McDonald

[57] ABSTRACT

A method of case hardening surfaces of steel parts insures the presence of a relatively high percentage of untempered martensite within a case hardened depth of at least ten thousandths of an inch. The untempered martensite provides for a Rockwell C surface hardness in the range of 59 to 68, and promotes greater resistance to abrasion and deformation. The method also creates compressive stresses in the surface case hardened depth, and thus measurably enhances the fatigue life of the latter surface as a contact bearing member. The method includes the completion of all conventional metal removal operations on the part including finish machining steps prior to heat treatment thereof. In one preferred form, the method includes the steps of (1) completing all machining operations on the part, (2) carburizing the part to achieve a high surface carbon concentration, (3) direct quenching the part in oil by means resulting in retension of 10 to 30 percent austenite in the case hardened depth, (4) time tempering the part and (5) work hardening the part to transform a substantial portion of the retained austenite into untempered martensite, resulting in a case depth having a composition including at least 5 to 20 percent untempered martensite.

13 Claims, 1 Drawing Figure

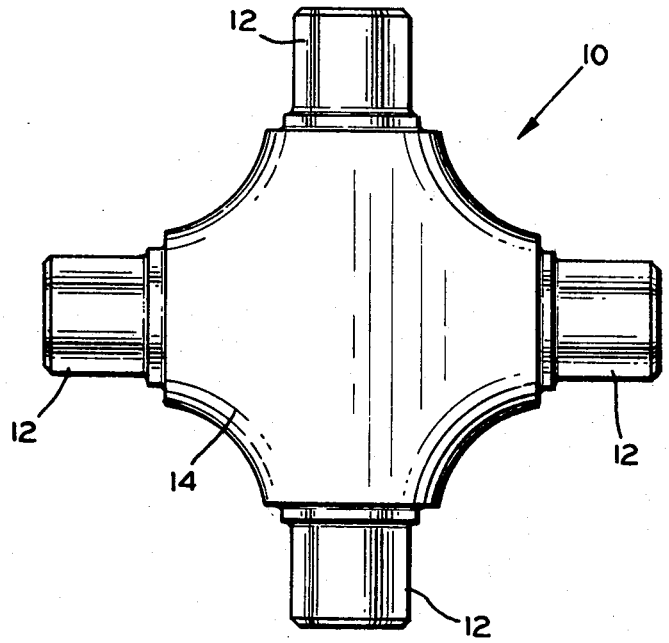
12
10
12
14
12
12

CASE HARDENING METHOD FOR STEEL PARTS

BACKGROUND OF THE INVENTION

This invention relates to the control of the surface or "case hardness" of steel parts. More particularly, it relates to control of case hardness quality and associated resistance of steel bearing surfaces to wear abrasion, and deformation.

Low surface hardnesses and commensurately poor wearability factors have resulted chiefly from procedures employed in the manufacture of prior art steel bearing surfaces, and particularly in those of trunnions as employed in universal joint cross members. Such members have been traditionally formed from steel forgings, wherein a common practice has been to heat treat the forging prior to all grinding or other metal removal steps. It is common knowledge that such grinding, buffing, or similar finish machining steps remove, at least in part, several thousandths of an inch of the hardened surface achieved from heat treatment and subsequent quenching operations. In fact, the effect of such post heat treatment machining or metal removal steps has been to remove any retained austenite in such case hardened surfaces. Retained austenite has been regarded as undesirable because of its tendency to be readily transformed into untempered martensite under conditions of work hardening, or even the flexure of parts under conditions of extremely cold temperatures. The general thinking in the industry has been that untempered martensite is to be avoided at all costs, as the latter has been associated with dimensional changes of finished parts, as well as brittleness and associated cracking.

Prior art trunnions have therefore been subjected to grinding steps after heat treatment and quenching procedures to remove substantial portions of case hardened layers typically having only 0 to 5 percent retained austenite. The deliberate avoidance of virtually all untempered martensite in the final product has thus resulted in bearing surfaces having less than desirable case hardnesses, along with associated relatively lower resistances to abrasion and deformation.

SUMMARY OF THE INVENTION

The invention disclosed herein provides a method of case hardening bearing surfaces of steel parts, wherein the surfaces have substantially improved abrasion and deformation resistances. The surfaces are preferably achieved by machining, carburizing, quenching, tempering, and work-hardening steps, whereby a relatively high percentage of the austenite achieved during carburizing is retained through quench. A significant percentage of the retained austenite is then purposefully transformed into untempered martensite under the work hardening step.

A preferred practice of the method comprises the steps of: (1) completing all machining, grinding, and similar operations involving metal removal steps, (2) carburizing the machine part to achieve a surface carbon concentration in the range of 0.9 to 1.3 percent, (3) direct quenching the part in oil by means resulting in the retention of 10 to 30 percent austenite in a case depth of at least ten thousandths of an inch, (4) time tempering the part in a controlled furnace environment at constant temperature, and (5) work hardening the part to transform a portion of the retained austenite into untempered martensite, resulting in the case depth having a composition including at least 5 to 20 percent untempered martensite.

BRIEF DESCRIPTION OF THE DRAWING

The drawing is a view of a case hardened joint cross member, as utilized in a preferred practice of this invention.

DETAILED DESCRIPTION AND PREFERRED PRACTICES OF THE METHOD

This invention is directed to case hardening of bearing surfaces of steel parts, for example, the surfaces of the trunnion 12 of a universal joint cross member 10 as shown in the drawing. The trunnions 12, which extend radially of the center body portion 14, are each disposed for rolling contact with needle bearings (not shown). Such surfaces should ideally have high abrasion and deformation resistance, but yet have sufficient strength to resist rolling contact fatigue.

The method consists of five basic steps, and the chart below displays a preferred sequence of the steps as employed in the practice of this invention.

| STEPS: (For SAE 8617 Steel): | | | | |
|---|---|---|---|---|
| 1 Machining | 2 Carburizing | 3 Direct Quench | 4 Tempering | 5 Work Hardening |
| Rough Turning | Temperature: 1550–1740° F. | Temperature: 1500–1650° F. | Temperature 300–400° F. | Technique: Shot Peen |
| Grinding or other Finish Machining | Duration: 3–6 hrs | Quenchant: Oil at 80–130° F. | Duration: 1–1½ hr | Material: ASTM 390: chilled steel shot |
| | Effective case depth: At least 10 thousandths of an inch Surface Carbon Concentration: 0.9 to 1.3% | Duration: 3–7 minutes | | Intensity: Almen Strip "A" arc height .016 to .026 |
| Case Hardness (Rockwell C) | | 63–67 | 59–64 | 59–68 |
| Compositions | | | | |
| Austenite Retained | | 10–30% | 10–30% | 5–10% |
| Tempered Martensite | | 0% | 70–90% | 70–90% |
| Untempered Martensite | | 70–90% | 0% | 5–20% |

First, the trunnions 12 of the member 10 are fully machined. An important feature of this invention is that all machining procedures are carried out in an initial phase, so as to avoid any machining away of resultant case hardened surface material. Referring to the chart, the cross member 10 is thus initially machined, the machining procedure comprising rough machining, such as lathe turning, immediately followed by all finish metal removal operations such as grinding to final dimension and tolerances, as or if required. The cross member 10 is preferably stamped as a forging, and the trunnions 12 are subsequently machined to final tolerances for proper operation in roller contact bearing service.

Next the member 10 is carburized at a temperature in the range of 1550° to 1740° F. This procedure is carried out for 3 to 6 hours under the preferred practice of this method. The carburizing furnace may, for example, be of the "pusher type continuous," wherein an endothermic gas may be used as a carrier in the production of a controlled environment for achieving a high carbon potential. The carrier is preferably enriched with one of the hydrocarbon gases, for example, a methane gas as will be appreciated by those skilled in the art. The preferred surface carbon concentration is in the range of 0.9 to 1.3 percent. Under the aforesaid conditions, such concentration will insure that the case depth subject to carbon penetration will be at least ten thousandths of an inch. It should be noted that these conditions will in some regions of the affected surface areas result in case hardened depths up to as much as fifty thousandths inch. The object of the carburizing procedure is to insure that a substantial amount of austenite is retained in the case hardened surface of the member 10.

Depending on the carbon content of the steel, as will be understood by those familiar with heat treatment of steels, the austenitic phase of steel is reached at 1333° F. for the eutectoid composition of 0.80% carbon, and at higher temperatures for any other carbon percentage values. It should be noted that of all steel phases, the austenite phase has the greatest afinity for receiving carbon atoms, yet only approximately two percent carbon can be absorbed within the steel, under ideal conditions. After carburization, if the steel is cooled slowly, the carbon atoms will migrate out of the crystaline structure of the austenite, and the composition will degenerate into an undesirable brittle structure, such as "cementite." Thus, a rapid quench is employed to effect a "freezing" of the austenitic structure before the carbon atoms have had a chance to migrate. The result is preferably a phase having a stronger, hence more desirable, crystaline structure at low temperatures, for example, martensite which is much more stable at lower temperatures than austenite, while only slightly differing from the latter in metallurgical properties.

Contrary to the present invention, wherein an effort is made to assure the greatest feasible amount of retained austenite (approximately 10–30 percent upon quench), prior art efforts have been directed to minimizing retained austenite (and hence resultant martensite) for reasons primarily directed to avoidance of brittleness and cracking of parts. As a result, the prior art techniques employed a carbon concentration in the range of only 0.8 to 1.0 percent to minimize the amount of retained austenite. The present invention, however, limits the problems of the prior art by tempering the member 10 after quench in order to reduce the unsatisfactorily large amount of untempered martensite produced by the quenching step, as further explained hereinafter.

Referring to the chart, in order to effect carburization, the steel member 10 must be made of a carburizing grade of steel. Obviously, the lower the carbon content of the steel, the more easily saturated the member will become in a comparatively shorter period of time. For example, a nickel-chromium steel of low carbon content, as SAE 8617, will achieve a carbon concentration of 0.9 to 1.3 to a minimum case hardened depth of at least ten thousandths of an inch at 1650° F. in 3 to 6 hours. An SAE 8610 steel, which has an identical composition except for lower carbon content, will absorb carbon more readily under the same conditions, while an SAE 8620 steel having higher carbon content will absorb correspondingly less carbon. (SAE 8617 steel has a carbon percentage of 0.17).

Upon removal of the member 10 from the carburizing furnace, allowing for but a slight drop in temperature down to a range of 1500° to 1650° F., the member is "direct quenched" in oil which is maintained at a temperature of 80° to 130° F., for three to seven minutes. A direct quench is more desirable than an indirect quench in the preferred procedure as an indirect quench results in a lesser amount of retained austenite. An indirect quench procedure, as "austempering" (more frequently utilized in the case of high carbon steels), involves quenching, then reheating the quenched member to a temperature slightly below the austenitic phase, then cooling more slowly to allow the austenite to transform to bainite, a softer ferritic phase having malleable characteristics unsuitable for bearing surfaces, as will be appreciated by those skilled in the art.

As shown in the chart, the direct oil quench results in a retained austenite percentage of approximately ten to thirty, and a Rockwell C hardness in the range of 63 to 67 over the case hardened surface to the member 10. It will be appreciated that an oil quench procedure provides for a substantially greater time control of the quench as compared to a water quenching procedure, which from high temperatures tends to more readily subject the member to surface cracking during the rapid cooling associated therewith.

A tempering procedure, next conducted, involves a reheating operation to relieve undesirable and fairly substantial tensile surface stresses induced by the direct quench operation. Thus, the member 10 is reheated and held for approximately 1½ hours at a constant temperature in a range of 300° to 400° F. During this period, the Rockwell C hardness decreases from 63 to 67 to a range of 59 to 64. Although a relatively high Rockwell C hardness is achieved upon quench, the amount of untempered martensite (70–90%—see chart), is extremely and unsatisfactorily high as earlier noted, and would result in the prior art problems related to fatigue and brittleness. Such a high percentage of untempered martensite must therefore be substantially reduced in order to enchance the strength of the part, and to avoid brittleness. Moreover, as the oil quench step also results in an uneven distribution of hardness over the surface, the tempering step also produces a more uniform hardness over the surface.

After tempering, the final operation comprises a work-hardening of the case depth. The work hardening procedure allows for a smaller and more desirable amount of untempered martensite within the surface of the part. It will be appreciated by those skilled in the art that only retained austenite is capable of being transformed into untempered martensite by working hardening. This is because once converted during the tempering step, the tempered martensite cannot be transformed back into untempered martensite by work hardening procedures. Thus, the retained austenite becomes the only source of untempered martensite after the quench and tempering steps.

The presently preferred work hardening procedure is shot peening, as for example achieved by the use of ASTM 390 chilled steel shot. The shot peening procedure converts a substantial portion of the residual retained austenite into untempered martensite, resulting in a composition having a five to twenty percent untempered martensite in an effective case hardened depth of at least ten thousandths of an inch, and achieving a Rockwell C hardness of 59 to 68. To effect this hardness level, the shot peening must be of an intensity sufficient to produce an Almen test strip "A" arc height of 16 to 26 thousandths of an inch, as will be fully appreciated by those skilled in the art.

It should be further noted that an additional benefit of work hardening the case hardened depth is the inducement of compressive stresses into the surface, thus also inherently enhancing the fatigue life of the part. The stresses result from the fact that the crystaline structure of untempered martensite is slightly larger than that of austenite. Thus there is a slight expansion of the surface case depth as a substantial portion of the retained austenite is transformed into untempered martensite by the shot peening procedure. The combination of the greater case hardness and the surface compressive stresses provides for an improved bearing surface for use in high stress contact roller environments, for example, those to which the trunnions 12 are subjected.

Other benefits are also realized in the practice of the above-described method of this invention, although not all are readily apparent. For example, the higher carbon concentration as employed herein is believed to produce a small percentage of carbides in the case hardened surface which also contributes to the improved wear resistance of the member 10.

The above-described preferred practice of this method is exemplary only, and numerous variants thereof are envisioned as falling within the spirit and scope of the appended claims. For example, the method could also be applied to other bearing parts, such as the inner race of a universal joint bearing cap as used to support the trunnion, or even to bearing portions of axle shafts and the like.

What is claimed is:

1. A method of forming a case hardened surface on a steel part made of a carburizing grade of steel, comprising the steps of: (a) completing all metal removal operations on said surface, including finish machining, (b) carburizing said surface to a surface carbon concentration in the range of 0.9 to 1.3%, (c) direct quenching said surface in oil by means resulting in retention of 10 to 30 percent austenite in said surface, (d) time tempering said surface in a controlled furnace environment at constant temperature, and (e) work hardening said surface to transform said retained austenite to at least 5 to 20 percent untempered martensite, and to induce compressive stresses into the case hardened surface.

2. The method of claim 1 wherein said carburizing step is conducted at a temperature in the range of 1550° to 1740° F.

3. The method of claim 2 wherein said carburizing step is conducted for a time period in the range of 3 to 6 hours, whereby said carbon concentration reaches a case depth of at least ten thousandths of an inch.

4. The method of claim 3 wherein said quenching step is effected when said part is at a temperature of at least 1500° F., and wherein said part is held in oil for five minutes, said oil having a temperature in the range of 80° to 130° F.

5. The method of claim 4 wherein said tempering step is effected at a temperature in the range of 300° to 400° F. for a time duration in the range of 1 to 1½ hours.

6. The method of claim 5 wherein said work hardening step is achieved by shot peening.

7. The method of claim 6 wherein said shot peening step is conducted with chilled steel shot.

8. The method of claim 7 wherein said quenching step produces a case hardened surface composition of 70 to 90 percent untempered martensite, and 10 to 30 percent retained austenite.

9. The method of claim 8 wherein after said work hardening step said case hardened surface comprises a 70 to 90 percent tempered martensite composition, and a five to twenty percent untempered martensite composition to a depth of up to ten thousandths of an inch.

10. The method of claim 9 wherein said surface carbon concentration is effected via a carburizing gas furnace, wherein an endothermic carrier gas is enriched via a hydrocarbon gas, whereby said carbon potential is achieved.

11. The method of claim 10 wherein said machining operations comprise (1) a rough turning step, and (2) a finish machining step.

12. The method of claim 11 wherein said case hardened surface has a hardness of a magnitude represented by an Almen test strip "A" arc height of sixteen to twenty-six thousandths of an inch.

13. A method of forming a case hardened surface on a steel part made of a carburizing grade of steel, comprising the steps of: (a) carburizing said surface to a surface carbon concentration in the range of 0.9 to 1.3 percent, (b) direct quenching of said surface in oil by means resulting in retention of ten to thirty percent austenite in said surface, (c) time tempering said surface in a controlled furnace environment at constant temperature, and (d) work hardening said surface to transform said retained austenite to at least five to twenty percent untempered martensite, and to induce compressive stresses into the case hardened surface.

* * * * *